US008109306B2

(12) United States Patent
Paulk

(10) Patent No.: US 8,109,306 B2
(45) Date of Patent: Feb. 7, 2012

(54) LUGGAGE PIECE WITH EXPANDABLE ACCESS OPENING

(75) Inventor: Darci Paulk, Chicago, IL (US)

(73) Assignee: Heritage Travelware, Ltd., Carol Stream, IL (US)

( * ) Notice: Subject to any disclaimer, the term of this patent is extended or adjusted under 35 U.S.C. 154(b) by 375 days.

(21) Appl. No.: 12/380,214

(22) Filed: Feb. 25, 2009

(65) Prior Publication Data

US 2010/0213019 A1 Aug. 26, 2010

(51) Int. Cl.
*A45C 13/00* (2006.01)

(52) U.S. Cl. ..... 150/118; 150/114; 190/903

(58) Field of Classification Search ..... 190/900, 190/903; 150/118, 113, 114
See application file for complete search history.

(56) References Cited

U.S. PATENT DOCUMENTS

| | | | | | |
|---|---|---|---|---|---|
| 909,248 | A * | 1/1909 | Staeger | 383/2 |
| 1,962,594 | A * | 6/1934 | Herrmann | 190/114 |
| 2,018,809 | A * | 10/1935 | Rodgers | 190/103 |
| D159,299 | S * | 7/1950 | Schlessinger | D3/246 |
| 2,802,500 | A * | 8/1957 | June | 150/136 |
| 3,912,055 | A * | 10/1975 | Malooly | 190/109 |
| 4,197,618 | A | 4/1980 | Bourguignon | |
| D277,619 | S | 2/1985 | Bomes et al. | |
| 4,821,853 | A * | 4/1989 | Young | 190/111 |
| D329,330 | S | 9/1992 | Pardo | |
| 5,324,115 | A | 6/1994 | Weinreb | |
| D379,869 | S | 6/1997 | Formby | |
| 5,687,848 | A | 11/1997 | Scholz et al. | |
| 5,704,480 | A | 1/1998 | Scholz et al. | |
| 5,987,715 | A | 11/1999 | Khon | |
| 6,105,764 | A * | 8/2000 | Scicluna et al. | 206/320 |
| 6,213,267 | B1 * | 4/2001 | Miller | 190/108 |
| D446,644 | S | 8/2001 | Tucker | |
| D463,118 | S | 9/2002 | Tucker | |
| D464,197 | S | 10/2002 | Kegels | |
| 6,678,923 | B2 | 1/2004 | Goldberg et al. | |
| 6,796,344 | B2 | 9/2004 | Chen et al. | |
| 7,293,635 | B2 | 11/2007 | Repke et al. | |
| 2003/0000612 | A1 | 1/2003 | Sutton | |
| 2005/0028908 | A1 | 2/2005 | Schaus et al. | |
| 2005/0052015 | A1 | 3/2005 | Hynek | |
| 2007/0193902 | A1 | 8/2007 | Myers et al. | |
| 2008/0116697 | A1 | 5/2008 | D'Ambrosio | |
| 2009/0032348 | A1 * | 2/2009 | Wang | 190/103 |

FOREIGN PATENT DOCUMENTS

| | | |
|---|---|---|
| WO | WO 2007/019181 A1 | 2/2007 |
| WO | WO 2007/095633 A2 | 8/2007 |

* cited by examiner

*Primary Examiner* — Tri Mai
(74) *Attorney, Agent, or Firm* — Pauley Petersen & Erickson

(57) ABSTRACT

A luggage piece which provides a slim profile in a closed position and a larger opening in an open position when compared to a similar article without features according to this invention. The luggage piece includes at least one gusset, positioned along a side of the luggage piece, which is folded in the closed position and releases and/or expands in the open position to provide a larger opening and thus greater access to a storage space.

12 Claims, 5 Drawing Sheets

LUGGAGE PIECE WITH EXPANDABLE ACCESS OPENING

BACKGROUND OF THE INVENTION

1. Field of the Invention

This invention is directed to a luggage piece, including but not limited to a purse, a computer bag, a briefcase and/or a handbag. More particularly, this invention is directed to a slim profile luggage piece, which when unzipped or opened expands to provide a greater opening and thus luggage capacity.

2. Discussion of the Related Art

Typically, consumers of luggage look for an item that will allow them to carry numerous and often large personal items including laptops, sunglasses, cell phones, personal digital assistants and cosmetic items. Luggage designers try to accommodate relatively large items by increasing the size of the luggage or by adding external compartments to hold large items. However, such an approach often results in bulky and unstylish luggage.

Because of stricter carry-on baggage rules at airports, consumers or travelers desire luggage pieces with relatively smaller overall dimensions, particularly luggage pieces that can accommodate or house laptop computers and/or other large personal items.

There is a need for a luggage piece with an enlarged opening that accommodates large items but also provides a desired slim and stylish appearance.

SUMMARY OF THE INVENTION

One general object of this invention is to provide a sleek and stylish luggage piece with an expandable opening for improved access to a storage space. Another general object of this invention is to provide a luggage piece with a relatively large opening, for accepting a relatively large item, while minimizing overall dimensions of the luggage piece.

The opening structure of this invention can be adopted to work with many conventional luggage pieces. In one embodiment of this invention, a luggage piece has six walls or sides, including a top wall, a bottom wall, a front wall, a rear wall and two opposing side walls. The six walls form a body which defines a void, such as a central storage space. The top wall can include a cuff, an access opening to the central storage space and a moveable closure. The closure is operable or movable between a closed position and an open position, and provides access to the central storage area when the closure is in the open position.

As used in this specification and the claims, the terms such as front, rear, top, bottom, side, end and the like are words of convenience and are not construed as limiting terms.

In one embodiment of this invention, a gusset is disposed between the front wall and/or the rear wall and each of the adjacent side walls. Each gusset is folded and narrowed when the closure is in the closed position, providing a relatively slim profile to the luggage piece. When operated or moved to the open position, each gusset releases and expands to an unfolded, substantially planar or flat position, thereby providing an expanded opening with increased access to the storage space, as compared to a similar luggage piece with no gusset.

In certain embodiments of this invention, each gusset includes a gusset fastener that helps fold and maintain each gusset in the closed position. Gusset fasteners of this invention can include, for example, magnets and magnetic material that responds to or cooperates with each corresponding magnet.

In some embodiments of this invention, the cuff and the closure form the top wall of the luggage piece. A width of the access opening is increased by expanding the gussets on each side of the luggage piece. In other embodiments of this invention, the cuff and/or the closure extend beyond each side and over the side walls of the luggage piece, to provide slack on each side of the luggage piece when in the open position.

Cuff fasteners can be used to secure ends of the cuff against a corresponding side wall of the luggage piece, particularly when in the closed position. The cuff fasteners, for example, can be a magnet in a cuff end or the side wall and a magnetically responsive material in the other of the cuff end or the side wall.

Different components of the luggage piece can be constructed of a durable material, such as a leather with a fabric liner, but also can be constructed of any suitable material including, but not limited to, a canvas, a vinyl and/or a cloth. The luggage piece can be sewn with seams and/or assembled using adhesives, rivets, a heat-seal and/or any combination of other suitable known connectors.

BRIEF DESCRIPTION OF THE DRAWINGS

These and other objects and features of this invention will be better understood from the following detailed description taken in conjunction with the drawings, wherein.

DETAILED DESCRIPTION OF THE INVENTION

FIGS. 1-5 illustrate one embodiment of luggage piece 10, such as a laptop computer bag. However, this invention is not limited to any particular type or use of luggage piece, and can be, without limitation, a purse, a briefcase, a tote, a handbag and/or an overnight bag. Luggage piece 10 of this invention is not limited to any particular shape or storage configuration, and can be of any desired shape including, but not limited to, a generally spherical shape, a generally triangular shape or a generally cubical shape. Each wall of the luggage piece of this invention can have any suitable overall shape including, but not limited to, a rectangle, a square, a triangle, a trapezoid and/or a circle.

Figure 1:
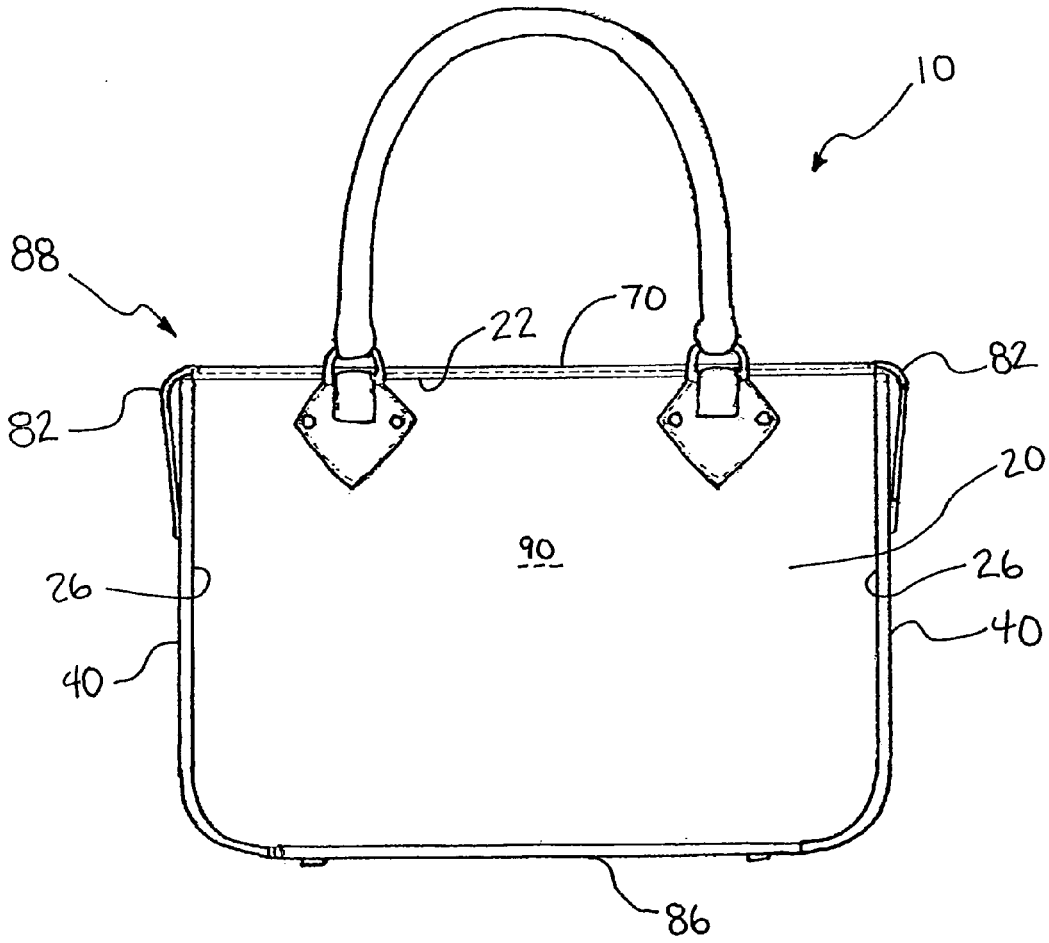
FIG. 1 is a front view of a luggage piece, according to one embodiment of this invention.
Figure 2:
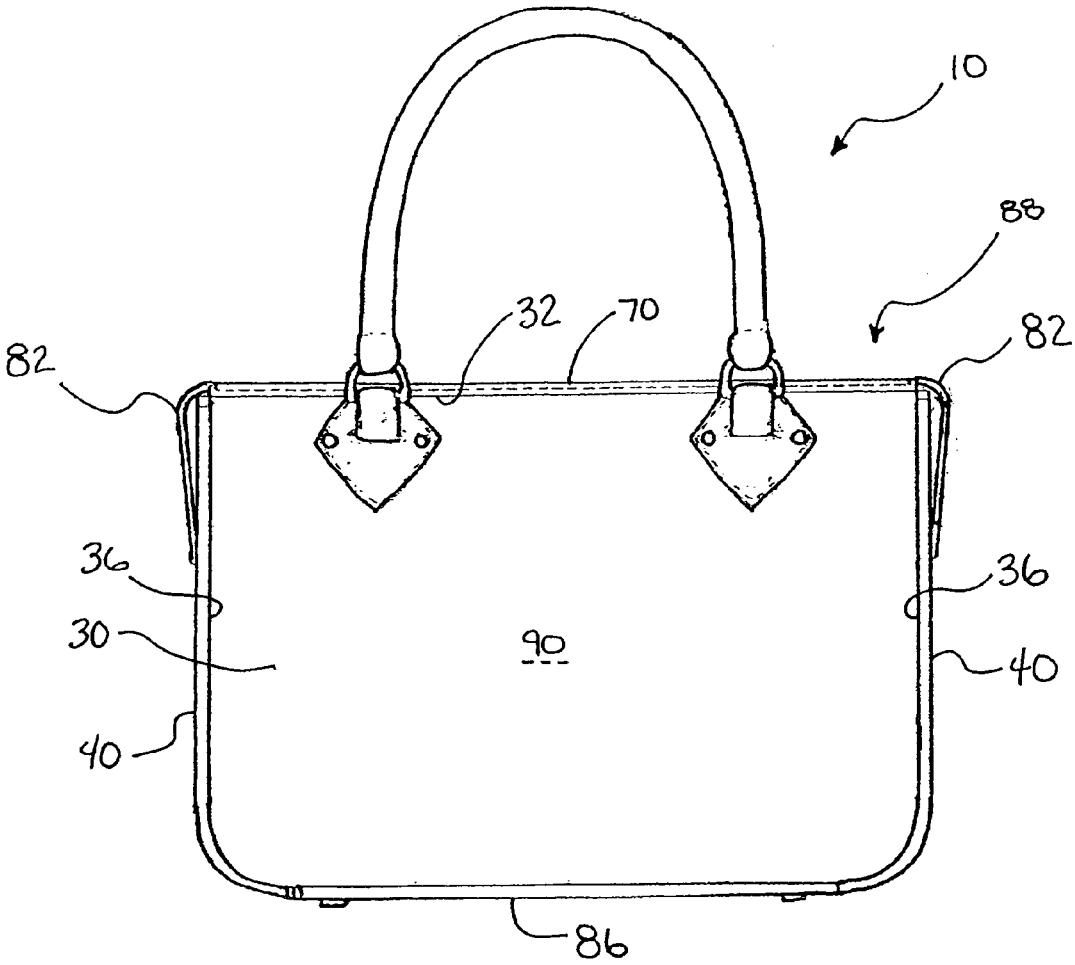
FIG. 2 is a rear view of the luggage piece of FIG. 1.
Figure 3:
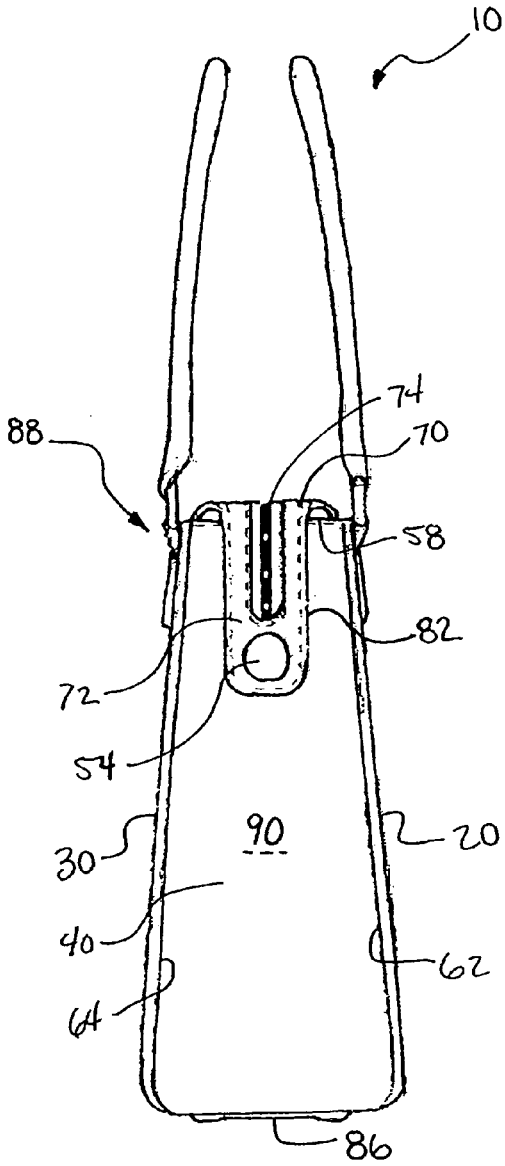
FIG. 3 is a side view of the luggage piece of FIG. 1, in a closed configuration.
Figure 5:
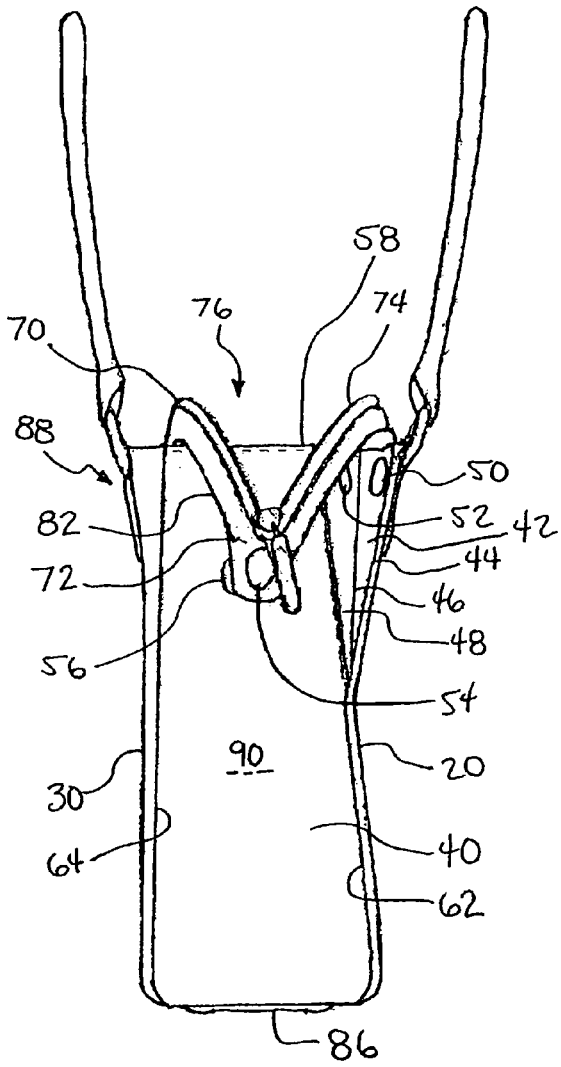
FIG. 5 is a side view of the luggage piece of FIG. 1, but in an open configuration.

FIG. 1 is a front view of luggage piece 10. FIG. 2 shows a rear view of luggage piece 10, which is opposite the front view shown in FIG. 1. In some embodiments, such as shown in FIGS. 3 and 5, luggage piece 10 comprises front wall 20 and opposing rear wall 30. In other embodiments, luggage piece 10 further comprises two opposing side walls 40, preferably but not necessarily substantially parallel to one another. Each side wall 40 can be disposed at an angle, such as approximately perpendicular, to front wall 20 and/or rear wall 30. In other embodiments, luggage piece 10 further comprises bottom wall 86 and top wall 70 which are generally parallel to one another and generally perpendicular to front wall 20, rear wall 30 and/or both side walls 40. Front wall 20, rear wall 30, side walls 40 and bottom wall 86 together can form at least a portion of body 88 of luggage piece 10. Body 88 surrounds and defines a space or a void, such as storage area 90 which may or may not be centrally positioned within or formed by body 88. In some embodiments of this invention, body 88 and thus storage area 90 are formed by only one wall.

In some embodiments of this invention, luggage piece 10 comprises lifts, such as handles or straps attached or connected directly or indirectly to body 88. Storage area 90 can be segmented into compartments. One or more compartments can be padded to protect stored items, for example, laptops, cell phones and personal digital assistants.

Luggage piece 10 can be operated between the closed configuration shown in FIG. 3 and the open configuration shown in FIG. 5. Although not shown, a figure showing the side views opposite of FIGS. 3 and 5 of luggage piece 10 could be a mirror-image of FIG. 3 in the closed configuration and of FIG. 5 in the open configuration. Closure 74 can be closed by bringing top edge 22 of front wall 20 and top edge 32 of rear wall 30 toward each other. Closure 74 can comprise a zipper and/or any connector, fastener or other suitable device that allows luggage piece 10 to be opened and closed repeatably. In some embodiments of this invention, closure 74 includes but is not limited to, buttons, snaps, hooks and loops fasteners and/or magnetic components.

Figure 4:
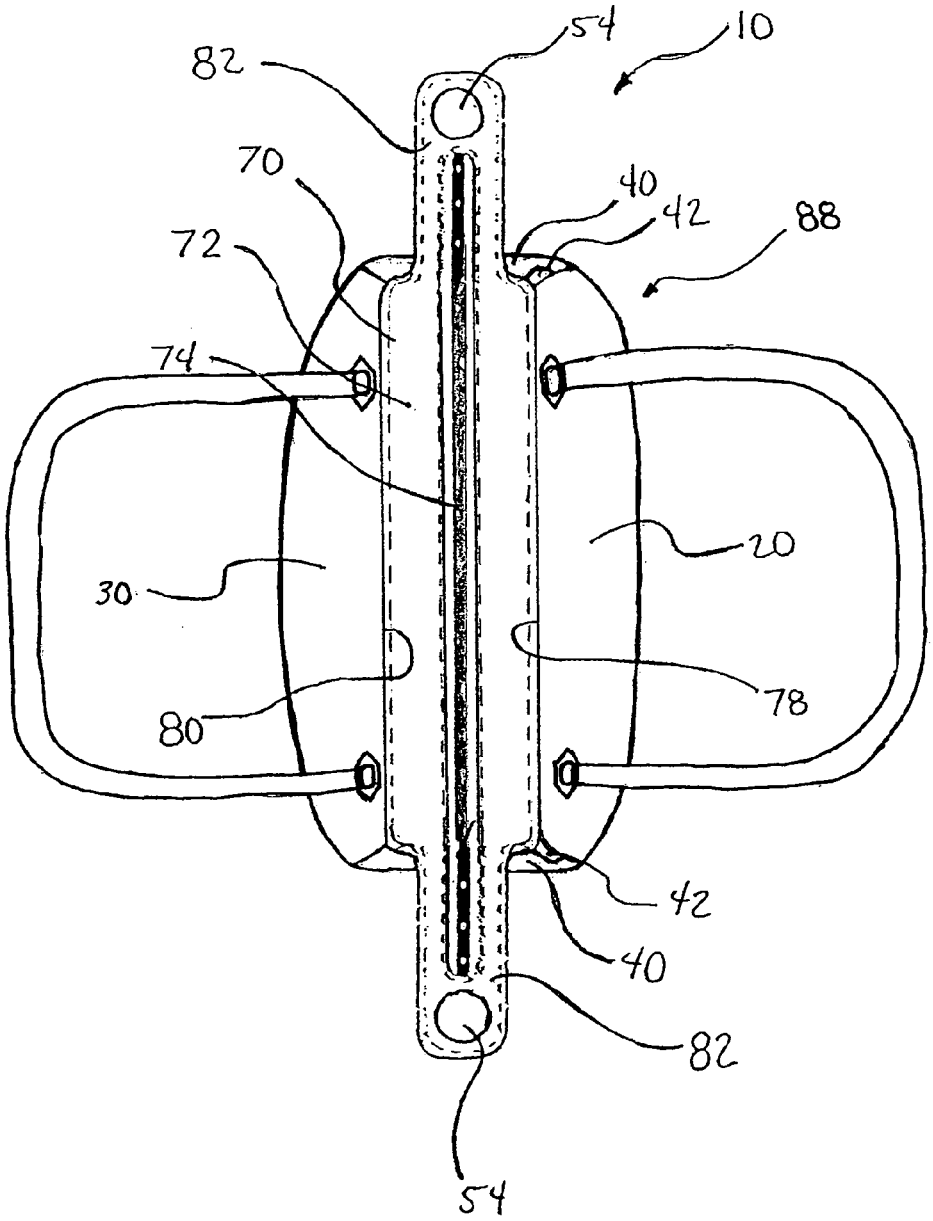
FIG. 4 is a top view of the luggage piece of FIG. 1, in a closed configuration.

FIG. 4 shows a top view of luggage piece 10 in the closed configuration with top 70 extended in a generally planar or flat orientation. Top 70 is formed at least partially by cuff 72 having front edge 78 connected to or integrated with front wall 20 and rear edge 80 connected to or integrated with rear wall 30. In some embodiments, cuff 72 comprises cuff extensions 82 on either side or both sides of luggage piece 10.

Different elements or components of luggage piece 10 can be integrated with each other or can be sewn and have seams and/or can be constructed using a variety of methods known in the art, such as by using adhesives, rivets, a heat seal and/or any combination of known connection methods. One or more walls of luggage piece 10 can be constructed of a durable material, such as leather with a fabric lining, but also can be constructed of any suitable material including, but not limited to a canvas, a vinyl and/or a cloth.

FIG. 5 is a side view of luggage piece 10 in the open configuration. In some embodiments, cuff 72 is disposed around or about access opening 76, with closure 74 extending within cuff 72. Closure 74 can move from the closed position, shown in FIGS. 3 and 4, to the open position, shown in FIG. 5, providing access to storage area 90. One or both cuff extensions 82 can extend beyond front wall 20, rear wall 30 and/or side walls 40. In some embodiments, closure 74 extends into each of the two cuff extensions 82

As shown in FIG. 5, gusset 42 is connected to and positioned between front wall 20 and side wall 40. Front wall 20 includes side edge 26 that connects to and/or is integrated with a lower portion of front side edge 62 of side wall 40. An upper portion of side edge 26 connects to and/or is integrated with gusset 42 at gusset end 44. As shown in FIG. 5, gusset end 44 transitions into gusset fold area 46 and then into gusset end 48. Gusset end 48 connects to an upper portion of front side edge 62 of side wall 40. Rear side edge 64 of side wall 40, which is opposite front side edge 62, connects to rear wall 30 at side edge 36, and can optionally include a gusset structure, such as shown in FIG. 5.

In the closed configuration, such as shown in FIG. 3, closure 74, and thus cuff 72, can move to the closed position and restrict or narrow top 70 by bringing or drawing together top edge 22 of front wall 20 and top edge 32 of rear wall 30. Because the width of top 70 is approximately equal to the width of top edge 58 of side wall 40, gusset 42 narrows when folded along gusset fold area 46, and brings gusset end 44 in proximity to or near gusset end 48. Desirably, gusset 40, in a folded position, lies adjacent to side wall 40 or front wall 20 when in the closed configuration.

In the open configuration, as shown in FIG. 5, closure 74 and thus cuff 72 is in the open position, allowing top 70 to substantially separate in a longitudinal direction or along a length of top 70, thereby providing access to storage area 90 through access opening 76. In some embodiments, such as shown in FIGS. 3-5, top wall 70 cannot completely separate because cuff 72 that surrounds closure 74 has connected ends. As discussed above, extensions 82 of cuff 72 extend beyond the width of front wall 20 and over side walls 40. By extending beyond the width of front wall 20, cuff 72 and closure 74 allow front edge 78 and rear edge 80 to move away from each other and expand gusset 42 and thus side wall 40 when in the open configuration. With cuff extensions 82, top edge 22 of front wall 20 can separate from top edge 32 of rear wall 30 by a distance greater than if cuff 72 has no extension 82 but rather ends at top edge 58 of side wall 40. In some embodiments, top edge 58 of side wall 40 is not connected to any other luggage component, such as cuff 72. This lack of connection allows gusset 42 to expand body 88 when in the open configuration.

With closure 74 open, gusset 42 can unfold and/or expand into a substantially planar or flat orientation. An unfolded gusset 42 enlarges access opening 76 and provides a larger opening for and thus greater access to storage area 90, as compared to a similar luggage piece without gusset 42.

In some embodiments of this invention, gusset 42 includes gusset fastener 50 in combination with an area near gusset end 44, and gusset fastener 52 in combination with an area near gusset end 48. Gusset fastener 50 and gusset fastener 52 are responsive to and/or engageable with each other and can couple or otherwise connect with respect to each other to hold gusset 42 in the folded and closed configuration. In one embodiment, gusset fastener 50 and gusset fastener 52 can be or can include a magnet and a magnetic material. However, various other fasteners are available for use as gusset fastener 50 and/or gusset fastener 52, including but not limited to, a button snap, a snap magnet, a turn-lock, a zipper, two magnets and/or hook and loop fasteners. In some embodiments, gusset fastener 50 and gusset fastener 52 are each positioned out of sight between layers, for example a leather layer and a cloth lining, of gusset 42.

In another embodiment of this invention, as illustrated in FIGS. 3-5, luggage piece 10 includes cuff fastener 54 connected or coupled to an end of cuff extensions 82 and side fastener 56 connected or coupled to the corresponding side wall 40. In the closed configuration, cuff fastener 54 and side fastener 56 are engageable with or are otherwise responsive to one another, to hold cuff 72 down and adjacent to each side wall 40 of luggage piece 10, as shown in FIGS. 1 and 2. This arrangement provides an aesthetically pleasant configuration, because extensions 82 are held down or tucked against side walls 40 rather than loose and unattached.

Similar to gusset fasteners 50 and 52, cuff fastener 54 and side fastener 56 can be or can include a magnet and a magnetic material engageable with the magnet or any other suitable fastener, including but not limited to, a button snap, a snap magnet, two magnets and/or hook and loop fasteners. In certain embodiments, cuff fastener 54 and side fastener 56 are positioned between layers of cuff 72 and side wall 40, respectively, so that cuff fastener 54 and side fastener 56 are hidden or not visible.

Luggage piece 10 is not limited to the generally rectangular sides or box-like configuration illustrated in the drawings.

Likewise, luggage piece 10 is not limited to six walls, but can have a different shape without separate front, rear, side, top and/or bottom walls. For example, rear wall 30, front wall 20, bottom wall 86, and/or side wall 40 can be constructed of a single piece of material formed and/or folded into a desired luggage shape. Alternatively, some panels and/or walls can be subdivided into separate sub-panels. For example, front wall 20 can be divided into two or more panels and/or side wall 40 can be divided into two or more panels, with gusset 42 positioned between these sub-panels.

In alternative embodiments, any number and configuration of gussets 42 can be positioned within body 88. For example, two gussets 42 can be used on each end of luggage piece 10 with side wall 40 positioned between each pair of gussets 42. In other embodiments, a single gusset 42 can be connected on one side of luggage piece 10, but no gusset connected to the opposing side wall. Also, gusset 42 is not limited to any size, configuration and/or number of folds. Gusset 42 can extend along a portion of or an entire side edge between front wall 20 and side wall 40. Front wall 20 can connect to gusset 42 at gusset end 44 and gusset edge 48 can connect to side wall 40. In some embodiments of this invention, luggage piece 10 does not include a separate side wall 40 but rather includes one gusset 42 on each side of luggage piece 10, between front wall 20 and rear wall 30. Gusset fold area 46 can have a bellows fold or an accordion-style fold. Gusset 42 can be constructed from an elastic material, with or without a bellows and/or fold area 46.

Figure 6:
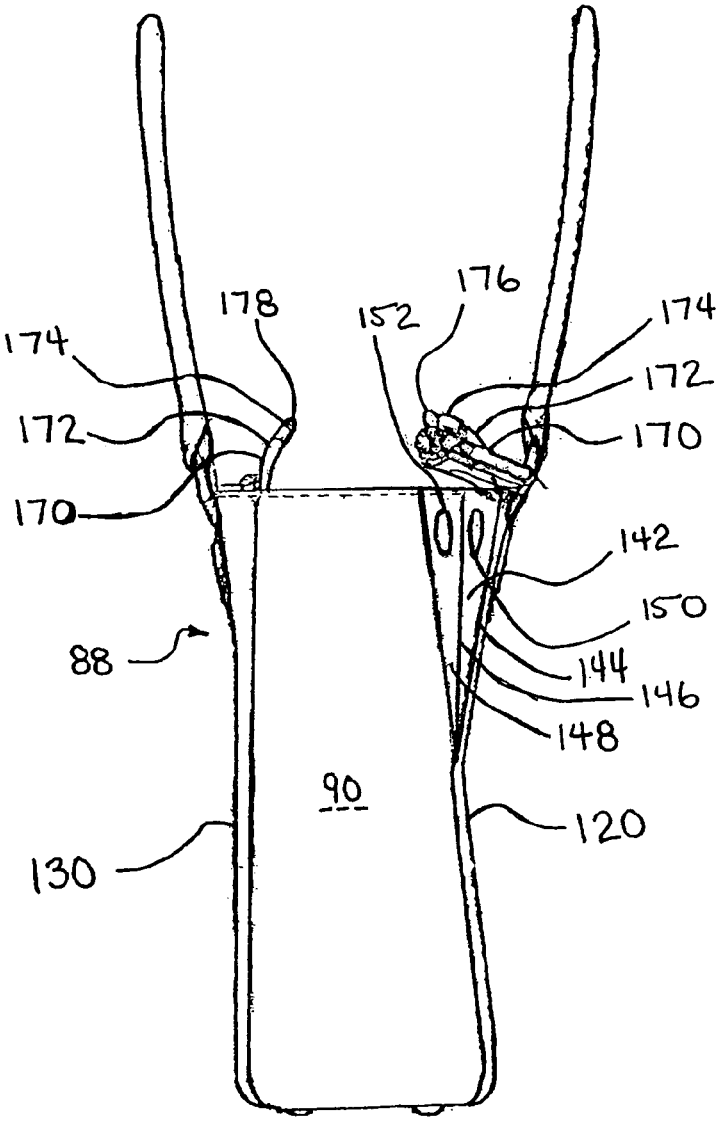
FIG. 6 is a side view of the luggage piece according to another embodiment of this invention, in an open configuration.

In an alternative embodiment shown in FIG. 6, top 170 can separate completely at closure 174 into two parts 176, 178 each comprising a portion of cuff 172 and a portion of closure 174. Part 176 is integrated with or connected to front wall 120 in the open position and part 178 is integrated with or connected to rear wall 130 in the open position. Because the ends of cuff 172 become unattached from each other, gusset 142 can unfold and expand when top wall 170 separates in the open configuration. Thus, in some embodiments, cuff 172 and closure 174 do not extend beyond the width of front wall 120.

In some embodiments, gusset 142 includes gusset fastener 150 integrated with or connected to an area near gusset end 144, and gusset fastener 152 integrated with or connected to an area near gusset end 148. Gusset fastener 150 and gusset fastener 152 cooperate with and/or are engageable with one another, such as described above, and can couple to one another to assist in holding gusset 142 closed when folded at gusset fold area 146.

Thus, this invention can provide an improved opening for luggage, a slim profile in the closed configuration and/or a larger opening when compared to a similar article without gussets or other similar structure in the open configuration.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of this invention.

What is claimed is:

1. A luggage piece comprising:

a body forming a storage space, the body including a front wall, a side wall, a top portion forming an opening for access to the storage space, and a closure moveable between a closed configuration and an open configuration providing access to the storage space through the access opening; and a gusset connected to the body and movable between a closed position when the closure is in the closed configuration and an open position when the closure is in the open configuration, the gusset including a first gusset fastener attached near the first gusset end and a second gusset fastener attached near the second gusset end, the first gusset fastener engaging with the second gusset fastener in the closed gusset position, the first gusset fastener comprising a magnet and the second gusset fastener comprising a material responsive to the magnet, the closure extending beyond the front wall and in the open configuration allowing the gusset to expand, the top portion comprising a cuff fastener attached on an end of the top portion and a side fastener attached to the side wall, and the cuff fastener and the side fastener cooperating with each other in the closed configuration.

2. The luggage piece of claim 1, wherein the cuff fastener or the side fastener comprises a magnet and an other of the cuff fastener or the side fastener comprises a material engageable with the magnet.

3. The luggage piece of claim 2, wherein the closure is a zipper.

4. The luggage piece of claim 1, wherein the closure extends beyond the front wall and in the open configuration allows the gusset to expand.

5. The luggage piece of claim 4, wherein the top portion comprises a cuff fastener attached on an end of the top portion and a side fastener attached to the side wall, and the cuff fastener and the side fastener cooperate with each other in the closed configuration.

6. The luggage piece of claim 5, wherein the cuff fastener or the side fastener comprises a magnet and an other of the cuff fastener or the side fastener comprises a material engageable with the magnet.

7. The luggage piece of claim 1, wherein the closure is a zipper.

8. A luggage piece comprising:

a body defining a storage area, the body including a front wall, a first side wall disposed at a first end of the front wall, a second side wall disposed at a second end of the front wall, a top portion including a cuff disposed about an access opening to the storage area;

the cuff including a closure moveable between a closed configuration and an open configuration providing access to the storage area through the access opening;

a first gusset connected to the front wall and to the first side wall;

a second gusset connected to the front wall and to the second side wall; and the first gusset and the second gusset each including a fold area foldable to bring a first gusset end adjacent to a second gusset end in a closed position when the closure is in the closed configuration, the first gusset and the second gusset each including a first gusset fastener attached near the first gusset end and a second gusset fastener attached near the second gusset end, and the first gusset fastener engaging with the second gusset fastener in the closed gusset position, the first gusset fastener comprising a magnet and the second gusset fastener comprising a material responsive to the magnet, the cuff further comprising a first end extending beyond the first end of the front wall and a second end extending beyond the second end of the front wall to allow the first gusset and the second gusset to expand in the open configuration, the first end of the cuff and the second end of the cuff each including a cuff fastener, and the first side wall and the second side wall each including a side fastener, and the cuff fastener engageable with the side fastener.

9. The luggage piece of claim 8, wherein the cuff fastener or the side cuff fastener comprises a magnet and an other of the cuff fastener or the side fastener comprises a material responsive to the magnet.

10. The luggage piece of claim 8, wherein the cuff further comprises a first end extending beyond the first end of the front wall and a second end extending beyond the second end of the front wall to allow the first gusset and the second gusset to expand in the open configuration.

11. The luggage piece of claim 10, wherein the first end of the cuff and second end of the cuff each includes a cuff fastener, and the first side wall and the second side wall each includes a side fastener, and the cuff fastener is responsive to the side fastener.

12. The luggage piece of claim 11, wherein the cuff fastener or the side fastener comprises a magnet and an other of the cuff fastener or the side fastener comprises a material responsive to the magnet.

* * * * *